US006837466B2

(12) United States Patent
Peltz

(10) Patent No.: US 6,837,466 B2
(45) Date of Patent: Jan. 4, 2005

(54) METHOD AND SYSTEM FOR COORDINATED TRANSFER OF CONTROL OF A REMOTE CONTROLLED LOCOMOTIVE

(75) Inventor: David Michael Peltz, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,840

(22) Filed: May 12, 2003

(65) Prior Publication Data

US 2003/0209638 A1 Nov. 13, 2003

Related U.S. Application Data

(60) Provisional application No. 60/379,628, filed on May 10, 2002.

(51) Int. Cl.[7] ..... B61L 3/00
(52) U.S. Cl. ..... 246/187 A
(58) Field of Search ..... 246/167 R, 186, 246/187 R, 187 A, 187 B

(56) References Cited

U.S. PATENT DOCUMENTS 5,284,097 A * 2/1994 Peppin et al. ..... 104/88.02
5,685,507 A * 11/1997 Horst et al. ..... 246/187 A
6,135,396 A * 10/2000 Whitfield et al. ..... 246/182 R

* cited by examiner

*Primary Examiner*—S. Joseph Morano
*Assistant Examiner*—Robert J. McCarry, Jr.
(74) *Attorney, Agent, or Firm*—Cantor Colburn LLP

(57) ABSTRACT

A method and system for coordinating the transfer of control of a remotely controlled locomotive is disclosed. The generation and assignment of command authority between remote controllers is accomplished by signal transfer between the remote controllers themselves, in contrast to a system that requires the use of a slave controller to determine, assign, and/or transfer command authority. In an exemplary embodiment, a transfer request is transmitted from a first control unit to a second control unit, the first control unit initially having a command authority. An acceptance of the transfer request is transmitted from the second control unit to the first control unit, and a confirmation of transfer is transmitted from the first control unit to the second control unit. Following the transmission of the confirmation of transfer from the first control unit to the second control unit, the second control unit assumes the command authority from the first control unit.

19 Claims, 3 Drawing Sheets

METHOD AND SYSTEM FOR COORDINATED TRANSFER OF CONTROL OF A REMOTE CONTROLLED LOCOMOTIVE

CROSS REFERENCE TO RELATED APPLICATIONS

This application claims the benefit of U.S. provisional application No. 60/379,628 filed May 10, 2002 the contents of which are incorporated by reference herein in their entirety.

BACKGROUND OF THE INVENTION

The present disclosure relates generally to remote controlled locomotives and, more particularly, to a method and system for coordinated transfer of control of a remote controlled locomotive.

The remote control operation of a locomotive is useful for allowing a ground-based operator to control the locomotive from trackside in a switching yard. A remote control unit typically includes one or more hand held transmitting units for communicating with a controller on the locomotive. This type of system permits an operator to perform such operations as coupling and uncoupling cars while retaining control over the speed of the locomotive by manually regulating the throttle and brake systems.

Since a remote control system can be used in conjunction with a train having multiple cars, it may be the case that an individual system operator cannot adequately view all of the cars at once. Accordingly, there are systems in existence that allow two or more operators to monitor different sections of the train. For example, in a two-operator system, each operator has a hand held transmitting unit, each of which has the capability of transmitting the full set of remote control commands to the locomotive. For obvious reasons, the system is designed such that (with the exception of certain commands) the controller on the locomotive will only accept commands from one of the transmitters at any given point in time. However, because it is desirable to be able to selectively designate which of the hand held controllers will have "command authority", there is a need to coordinate and control such a transfer of command authority in an appropriate and effective manner.

U.S. Pat. No. 5,685,507 issued to Horst, et al. discloses a remote locomotive control system in which the transfer of command authority from one transmitter to another is processed and executed by a slave controller mounted on board the locomotive. The slave controller initially assigns a "command authority holder status" to one of the transmitters and a "command authority non-holder status" to another of the transmitters. The slave controller keeps track of the current command authority holding transmitter by including a memory portion that associates a specific transmitter identifier with the command authority holder. When it is desired to change the command authority from the current command authority holder to a current command authority non-holder, the slave controller receives a transfer command signal from the transmitter having the command authority. Assuming certain safety checks are first met, if a command authority non-holder transmitter acknowledges (within 10 seconds) the transfer request by an appropriate signal (in this case, by transmitting a "reset" bit set at high), then the CPU within the slave controller shifts in memory the identifier associated with the reset bit at high to the position of the current command holder.

Essentially, the slave controller is the entity that determines which transmitter has the control authority. Each command signal sent by a given transmitter includes an identifier therewith, which identifies the specific transmitter sending the command signal. Depending upon the command sent, the slave controller then examines the identifier to see whether the command comes from the command authority holder.

A drawback, however, of the system in '507 patent stems from the fact that it is the slave controller (remotely located on board an unmanned locomotive) that ultimately has the responsibility of assigning and determining which transmitter has the command authority, as well as implementing a change in the command authority. If there is any problem with system hardware, software, or even with external operator-to-operator coordination, then there is no person "in the loop" to manage an unexpected or erroneous transfer of authority.

BRIEF DESCRIPTION OF THE INVENTION

The above discussed and other drawbacks and deficiencies of the prior art are overcome or alleviated by a method and system for coordinating the transfer of control of a remotely controlled locomotive. The generation and assignment of command authority between remote controllers is accomplished by signal transfer between the remote controllers themselves, in contrast to a system (such as the '507 patent) that requires the use of a slave controller to determine, assign, and/or transfer command authority.

In an exemplary embodiment, a transfer request is transmitted from a first control unit to a second control unit, the first control unit initially having a command authority. An acceptance of the transfer request is transmitted from the second control unit to the first control unit, and a confirmation of transfer is transmitted from the first control unit to the second control unit. Following the transmission of the confirmation of transfer from the first control unit to the second control unit, the second control unit assumes the command authority from the first control unit.

In another embodiment, a method and system is disclosed for coordinating the transfer of control of a remotely controlled locomotive between a first operator control unit having primary command authority asserted to a locomotive control unit, and a second operator control unit not having primary command authority asserted to the locomotive control unit. A pitch, initiated by an operator of the first operator control unit, is received by the first operator control unit. A catch request is then transmitted from the first operator control unit to the second operator control unit. The second operator control unit transmits to the first operator control unit an acceptance of the catch request by an operator of the second operator control unit. Then, the operator of the first operator control unit receives a confirmation of the pitch. Following the confirmation of the pitch, the second operator control unit asserts primary command authority to the locomotive control unit and the first operator control unit does not assert primary command authority to the locomotive control unit.

In still another embodiment, a remote control system for a locomotive includes a first operator control unit for transmitting a set of commands to a locomotive control unit within the locomotive. A second operator control unit is for transmitting a set of commands to the locomotive control unit. One of the operator control units has a primary command authority at a given time, with each of the first and said second operator control units providing a signal to the locomotive control unit indicative of whether it has the primary command authority.

BRIEF DESCRIPTION OF THE DRAWINGS

Referring to the exemplary drawings wherein like elements are numbered alike in the several Figures.

DETAILED DESCRIPTION OF THE INVENTION

Figure 1:
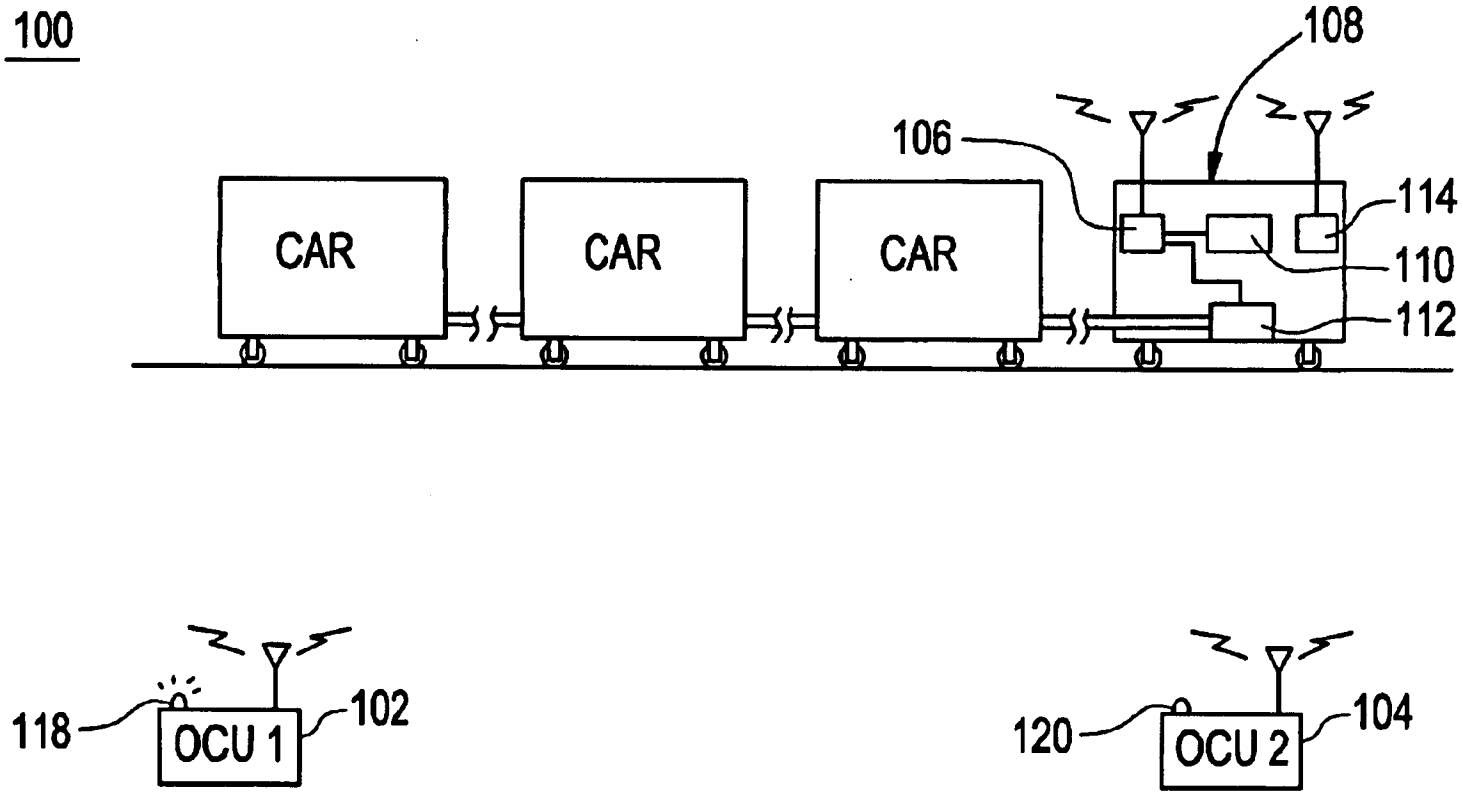
FIG. 1 is a schematic diagram of an exemplary remote controlled locomotive system 100 suitable for use in conjunction with the present invention embodiments.

Referring initially to FIG. 1, there is shown a schematic diagram of an exemplary remote controlled locomotive system 100 suitable for use in conjunction with the present invention embodiments. The system 100 includes both a first hand held operator control unit (OCU) 102 and a second OCU 104 for transmitting digitally encoded radio frequency (RF) signals to convey commands to a locomotive control unit (LCU) 106 mounted on board a locomotive 108. The LCU 106 decodes the transmitted signals from the OCUs and (depending on which OCU has command authority) operates various actuators (e.g., throttle 110, brake 112) to implement the commands transmitted by the OCU having command authority. Although there are two OCUs depicted in FIG. 1, the system 100 could also include an additional number of OCUs.

In addition, FIG. 1 also illustrates an optional, on board signal repeater 114 that may be used to relay communications between the OCUs 102, 104 and the LCU 106, or between the OCUs themselves. Similarly, an off board repeater (not shown) could also be used as a signal relaying device.

As stated above, it is desirable for the operators to be able to selectively designate which of the hand held OCUs will have command authority, and to communicate and confirm the transfer of control directly between the OCU's and the operators. This is contrast to certain existing remote control systems, such as that disclosed in the '507 patent discussed earlier, in which the on-board or locomotive control unit assigns a status of "command. authority holder" to one of the operator control units and a status of "command authority non-holder" to one or more remaining operator control units. The locomotive control unit 106 in this type of command transfer system is further responsive to a "command relinquish" RF signal in order to honor the full set of commands sent from the operator control unit having "command authority holder" status, as well as a subset of commands from the operator control unit(s) having "command authority non-holder" status. If a command transfer request is sent from the "command authority holder" operator control unit to the locomotive control unit, and (assuming any safety checks are also passed) if one of the "command authority non-holder" operator control units subsequently transmits a reset signal, then the locomotive control unit shifts the status of "command authority holder" to that operator control unit that transmitted the reset signal. In effect, the locomotive control unit (i.e., the slave controller) determines from which operator control unit it will accept the full range of commands, based on the operator's action to give up control.

However, a significant drawback of this command transfer method is that the locomotive control unit, mounted within the unmanned locomotive (which may be some distance away from either operator of the operator control units) is ultimately the component that has the final authority for transferring the command authority from one operator control unit to another operator control unit. If there is any problem with system hardware, software, or even with external operator-to-operator coordination, then there is no person "in the loop" to manage an unexpected or erroneous transfer of authority and no confirmation to the operators that transfer has in fact been implemented.

Therefore, in accordance with an embodiment of the invention, there are disclosed methods and systems of transferring control of a locomotive in a operator-to-operator coordinated fashion such that human operators are left "in the loop" so as to have final authority to transfer control, and with confirmation of transfer of control to the operators but without the need for relying on external coordination for scheduling the transfer.

Broadly stated, under the processes and systems of the present invention embodiments, the transfer of remotely controlled locomotive control is implemented without having to communicate with the LCU 106 at all. Rather, a series of requests and acknowledges are sent through an OCU to OCU order-wire. Although the system requires that the operator first confirm that the locomotive is in an appropriate state (e.g., stopped) before transfer of control is accomplished, it is the operator and not the LCU 106 that has the final say in the transfer.

Figure 2:
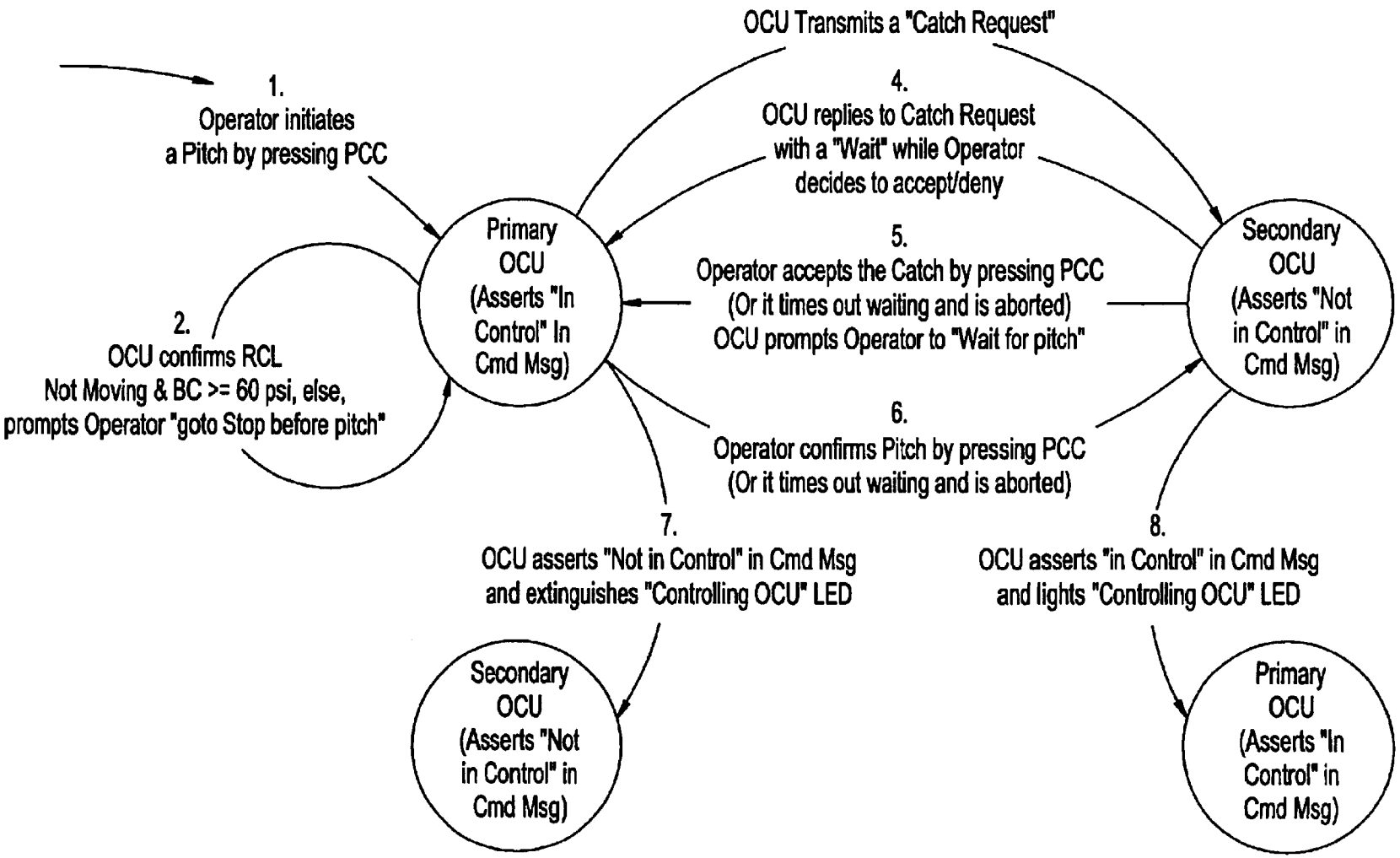
FIG. 2 is a signal state diagram which illustrates a method and system for coordinated transfer of control of a remote controlled locomotive, in accordance with an embodiment of the invention.

Referring now to FIG. 2, there is shown a state diagram illustrating the principles of the transfer of command between a primary OCU and a secondary OCU. It will be appreciated that although only two OCUs are shown in FIG. 2, the principles of the present invention embodiments are equally as applicable to a remote control system using several LCUs, one of which retains the primary command control at a given time.

The first OCU 102, by way of example, is initially designated as a "primary" OCU, in that it holds the primary command authority. Within each command message transmitted to the LCU 106 by first OCU 102, an "in control" indicator is included. In other words, the first OCU 102 generates a command authority signal included within each command message. Preferably, the first OCU 102 (initially being the primary OCU) also includes a physical indication, such as an illuminated LED 118 (FIG. 1), to signify to an operator of the first OCU 102 that he/she has the primary command authority. Correspondingly, the second OCU 104 is initially designated as a "secondary" OCU, in that it does not hold the primary command authority. The second OCU 104 may, however, be capable of transmitting certain universal commands, such as to engage an emergency brake or to sound a horn. Whenever a command is transmitted from a secondary OCU (such as second OCU in the initial state), a "not in control" indicator will be included with such a command. This can be in the form of a specific "non-command authority signal", or alternatively, by the absence of a command authority signal included within a transmitted command. In addition, while retaining the status of a secondary OCU, an "in control" LED 120 (FIG. 1) on the second OCU 104 will remain extinguished until such time as the second OCU obtains the primary command authority.

It will now be assumed that the operator of the primary OCU (first OCU 102) wants to transfer primary command authority to the operator of the secondary OCU (second OCU 104). As shown in FIG. 2, the operator of the primary OCU initiates a "pitch" by pressing a primary command change (PCC) button on the first OCU 102. Before transmitting the pitch to the second OCU 104, the first OCU confirms certain desired parameters (e.g., the locomotive not moving, the pressure in the brake system is at a predetermined level, etc.). If, for example, the locomotive is moving when the pitch is initiated, the first OCU will prompt the operator to stop the locomotive before pitching over the transfer request.

Assuming the desired preconditions are satisfied, the first OCU 102 then transmits a "catch" request directly to the second OCU 104, signifying a request for the second OCU 104 to now become the primary OCU. When the catch request is received by the second OCU 104, it then verifies or replays the catch request back to the first OCU 102, along with a "wait" signal, while the operator of the second OCU 104 decides whether or not to accept the catch request and assume primary command authority. If the operator of the second OCU 104 decides to accept the catch request, then he/she passes this information along to the operator of the first OCU 102 by pressing a corresponding PCC button on the second OCU 104. The second OCU 104 then prompts its operator to wait for the pitch (i.e., the transfer of primary command authority).

On the other hand, if the operator of the second OCU 104 does not acknowledge the catch request after a predetermined time period, then the system times out and the transfer process is aborted. However, assuming that the catch request is accepted, then the operator of the first OCU 102 must also confirm the pitch by once again pressing the PCC. This allows for a human-based final decision to transfer the primary command authority. If the pitch is not finally confirmed within a certain time period, then the transfer process is aborted. If the pitch is confirmed, then the transfer process is completed. As reflected in FIG. 2, the first OCU 102 now becomes the secondary OCU, wherein the "in control" LED 118 is then extinguished. Furthermore, the first OCU 102 asserts in a command message to the LCU 106 that it no longer has primary command authority. At the same time, the second OCU 104 now becomes the primary OCU. The "in control" LED 120 associated therewith is now illuminated, and a command message is sent to the LCU indicating that the second LCU 104 has primary command authority. Finally, if at some point it is desired to transfer the primary command authority from the second OCU 104 back to the first OCU 102, then the above-described process is again implemented, beginning with the operator of the second OCU 104 initiating a pitch request.

Figure 3:
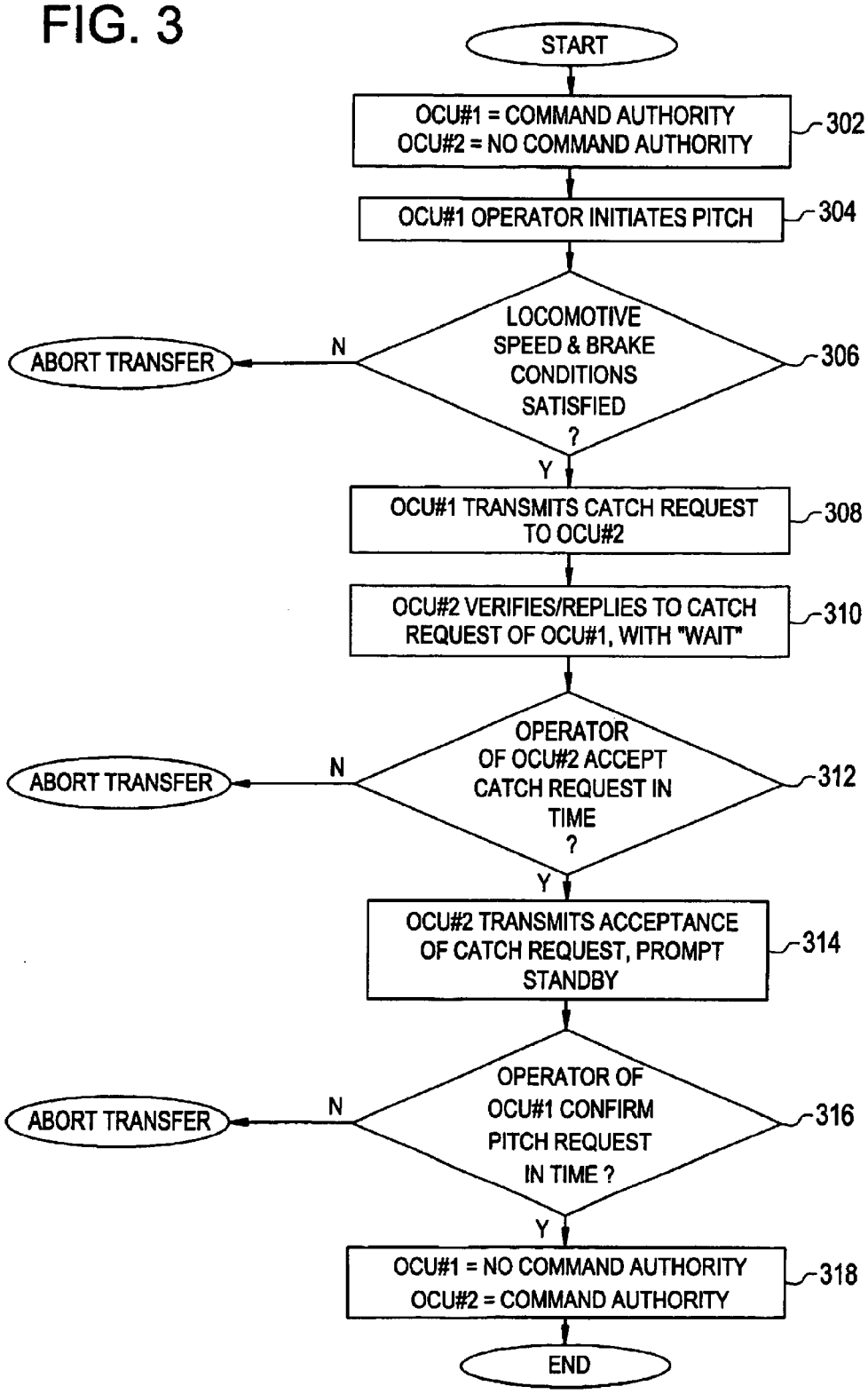
FIG. 3 is a flow diagram which alternatively illustrates the method and system shown in FIG. 2.

An alternative representation of the state diagram of FIG. 2 is depicted by the flow diagram of FIG. 3, as reflected in blocks 302 through 318.

As can be seen, the above-described method provides for the transfer of command authority directly between a pair of operator control units without the need for an external coordination to schedule the transfer. In the event of a malfunction wherein two or more linked OCUs assert an "in control" command message to the LCU 106, then the LCU 106 will report a fault and go to a "park" state. Optionally, the pitch and catch messages transmitted between OCUs may be passed through either on board signal repeater 114 or an off board signal repeater (not shown), where direct communications between OCUs are hampered. It will be appreciated by those skilled in the art that such a signal repeater would function a signal pass-through entity, and not as a device for responding to a transfer request signal or for assigning command authority to a transmitter. In other words, the operators are still charged with the ultimate transfer decision-making.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for coordinating the transfer of control of a remote controlled locomotive, the method comprising:

transmitting a transfer request from a first control unit to a second control unit, said first control unit initially having a command authority;

transmitting an acceptance of the transfer request from said second control unit to said first control unit; and transmitting a confirmation of transfer from said first control unit to said second control unit;

wherein, following the transmission of said confirmation of transfer from said first control unit to said second control unit, said second control unit assumes said command authority from said first control unit, and wherein a locomotive control unit associated with the locomotive receives a command authority signal generated by one of said first control unit and said second control unit.

2. The method of claim 1, wherein:

prior to said transmitting a confirmation of transfer from said first control unit to said second control unit, said first control unit generates said command authority signal; and subsequent to said transmitting a confirmation of transfer from said first control unit to said second control unit, said second control unit generates said command authority signal.

3. A method of claim 2, wherein:

said first control unit provides an indication to an operator thereof as to whether said first control unit is generating said command authority signal; and said second control unit provides an indication to an operator thereof as to whether said second control unit is generating said command authority signal.

4. The method of claim 1, wherein:

if said transmitting an acceptance of the transfer request from said second control unit to said first control unit is not carried out within a first determined time following said transmitting a transfer request, then the transfer of control is aborted.

5. The method of claim 4, wherein:

if said transmitting a confirmation of transfer from said first control unit to said second control unit is not carried out within a second determined time following said transmitting an acceptance of the transfer request, then the transfer of control is aborted.

6. The method of claim 1, wherein said transmitting a transfer request from a first control unit to a second control unit is initiated by an operator of said first control unit.

7. The method of claim 6, wherein:

following said transmitting a transfer request, said second control unit prompts said operator of said first control unit to wait for an operator of said second control unit to accept or deny said transfer request.

8. The method of claim 7, wherein:

following said transmitting an acceptance of the transfer request, said second control unit prompts said operator of said second control unit to wait for a transfer of command.

9. The method claim 1, wherein:

prior to said transmitting transfer request, said first control unit verifies the locomotive is in a stopped condition.

10. A method for coordinating the transfer of control of a remotely controlled locomotive between a first operator control unit having primary command authority assorted to a locomotive control unit, and a second operator control unit not having primary command authority assorted to the locomotive control unit, the method comprising:

receiving, at the first operator control unit, a pitch initiated by an operator of the first operator control unit;

transmitting a catch request from the first operator control unit to the second operator control unit;

transmitting, from the second operator control unit to the first operator control unit, an acceptance of said catch request by an operator of the second operator control unit; and receiving, from said operator of the first operator control unit, a confirmation of said pitch;

wherein, following said confirmation of said pitch, the second operator control unit asserts primary command authority to the locomotive control unit and the first operator control unit does not assert primary command authority to the locomotive control unit.

11. The method of claim 10, wherein:

following said transmitting a catch request from the first operator control unit to the second operator control unit, the second operator control unit further acknowledges said catch request from the first operator control unit by sending a wait signal thereto.

12. The method of claim 11, further comprising:

following said transmitting a catch request from the first operator control unit to the second operator control unit, waiting for said operator of the second operator control unit to accept said catch request;

wherein, if said operator of the second operator control unit accepts said catch request within a first determined time period, then the second operator control unit sends said acceptance to the first operator control unit; and if said operator of the second operator control unit does not accepts said catch request within said first determined time period, then the transfer of control is aborted.

13. The method of claim 12, further comprising:

following said transmitting of said acceptance of said catch request, waiting for said operator of the first operator control unit to confirm said pitch within a second determined time period;

wherein, if said operator of the first operator control unit confirms said pitch within said second determined time period then the second operator control unit asserts primary command authority to the locomotive control unit and the first operator control unit does not assert primary command authority to the locomotive control unit.

14. The method of claim 10, wherein prior to said transmitting said catch request, said first control unit verifies the locomotive is in a stopped condition.

15. A remote control system for a locomotive, comprising:

a first operator control unit for transmitting a set of commands to a locomotive control unit within the locomotive;

a second operator control unit for transmitting a set of commands to said locomotive control unit;

wherein one of said first and said second operator control units has a primary command authority at a given time, and wherein each of said first and said second operator control units provides a signal to said locomotive control unit indicative of whether it has said primary command authority.

16. The remote control system of claim 15, wherein said one of said first and said second operator control units having said primary command authority transfers said primary command authority to the other of said first and said second operator control units by initiating signal communication therebetween.

17. The remote control system of claim 16, wherein said primary command authority is transferred by:

a transfer request transmitted from said one of said first and said second operator control units to said other of said first and said second operator control units;

an acceptance of said transfer request transmitted from said other of said first and said second operator control units to said one of said first and said second operator control units; and a confirmation of transfer transmitted from said one of said first and said second operator control units to said other of said first and said second operator control units;

wherein, following the transmission of said confirmation of transfer, said other or said first and said second operator control units assumes said command authority from said one of said first and said second operator control units.

18. The remote control system of claim 15, further comprising a signal repeater for repeating signal transmissions between said first and second operator control units, said signal repeater further being capable of repeating signal transmissions between said locomotive control unit and said first and said second operator control units.

19. The remote control system of claim 15, wherein each of said first and said second operator control units further comprises a indicator for indicating to an operator there of whether that operator control unit has said primary command authority.

* * * * *